US012076609B2

(12) United States Patent
Duplechain

(10) Patent No.: US 12,076,609 B2
(45) Date of Patent: Sep. 3, 2024

(54) TRANSFORMABLE EXERCISE APPARATUS

(71) Applicant: Jack Duplechain, Los Angeles, CA (US)

(72) Inventor: Jack Duplechain, Los Angeles, CA (US)

( * ) Notice: Subject to any disclaimer, the term of this patent is extended or adjusted under 35 U.S.C. 154(b) by 0 days.

(21) Appl. No.: 18/130,260

(22) Filed: Apr. 3, 2023

(65) Prior Publication Data

US 2023/0233901 A1 Jul. 27, 2023

Related U.S. Application Data

(63) Continuation of application No. 17/156,623, filed on Jan. 24, 2021, now Pat. No. 11,617,915, which is a (Continued)

(51) Int. Cl.
*A63B 21/00* (2006.01)
*A63B 21/04* (2006.01)
(Continued)

(52) U.S. Cl.
CPC ..... *A63B 21/4029* (2015.10); *A63B 21/0442* (2013.01); *A63B 21/0552* (2013.01); *A63B 21/0726* (2013.01); *A63B 23/0458* (2013.01); *A63B 71/0036* (2013.01); *A63B 2071/025* (2013.01); *A63B 2208/0233* (2013.01); (Continued)

(58) Field of Classification Search
CPC ... A47B 83/001; A47B 85/06; A47B 2220/06; A63B 21/0442; A63B 21/0552; A63B 21/0726; A63B 21/151; A63B 21/4029; A63B 23/0458; A63B 23/1218; A63B 71/0036; A63B 2023/0411; A63B 2071/025; A63B 2208/0233; A63B 2208/0242; A63B 2210/50; A63B 2225/09; A63B 2225/105; A63B 2225/682
See application file for complete search history.

(56) References Cited

U.S. PATENT DOCUMENTS 4,477,074 A * 10/1984 Bushnell ..... A63B 21/078 482/106
5,082,260 A * 1/1992 Dinelli ..... A63B 21/4029 482/104
(Continued)

*Primary Examiner* — Joshua Lee
(74) *Attorney, Agent, or Firm* — Nolan Heimann LLP; Adam Diament

(57) ABSTRACT

A transformable exercise apparatus is disclosed. The exercise apparatus includes base arms parallel to each other, front legs and rear legs extending from the base arms. The exercise apparatus includes top arms, each connecting respective front and rear leg of each base arm. The exercise apparatus presents telescopic members stored in the front legs. The exercise apparatus includes a first table top and a second table top. The second table top includes collapsible legs. The collapsible legs fold and allow for placing the second table top and the first table top over the top arms, thereby transforming the exercise apparatus into a furniture. The second table top demounts and transforms into a workbench. The telescopic members extend and include a pull-up bar at the top, transforming the exercise apparatus into a pull up exercise apparatus. The apparatus may transfer into a leg press and arm press.

14 Claims, 12 Drawing Sheets

Related U.S. Application Data continuation-in-part of application No. 29/745,835, filed on Aug. 10, 2020, now Pat. No. Des. 973,719.

(60) Provisional application No. 62/965,127, filed on Jan. 23, 2020.

(51) Int. Cl.

| | |
|---|---|
| ***A63B 21/055*** | (2006.01) |
| ***A63B 21/072*** | (2006.01) |
| ***A63B 23/04*** | (2006.01) |
| ***A63B 71/00*** | (2006.01) |
| *A63B 71/02* | (2006.01) |

(52) U.S. Cl.

CPC ... *A63B 2208/0242* (2013.01); *A63B 2210/50* (2013.01); *A63B 2225/09* (2013.01); *A63B 2225/105* (2013.01); *A63B 2225/682* (2013.01)

(56) References Cited

U.S. PATENT DOCUMENTS

| | | | | |
|---|---|---|---|---|
| 6,454,683 | B1 | 9/2002 | Kaye | |
| 7,591,763 | B1 | 2/2009 | Fucci | |
| 9,370,678 | B2 * | 6/2016 | Prusaitis | A63B 23/0211 |
| 9,682,307 | B2 | 6/2017 | Dalebout | |
| 10,092,791 | B2 | 10/2018 | Donnelly et al. | |
| 2015/0038304 | A1 * | 2/2015 | Davenport | A63B 23/1218 482/123 |
| 2016/0001116 | A1 * | 1/2016 | Prusaitis | A47B 13/088 482/142 |

* cited by examiner

TRANSFORMABLE EXERCISE APPARATUS

CROSS-REFERENCE TO RELATED APPLICATIONS

This application is a continuation of U.S. application of Ser. No. 17/156,623, filed on Jan. 24, 2021, entitled "Transformable Exercise Apparatus," to Jack Duplechain, which is a continuation-in-part of U.S. Design patent application No. 29/745,836, filed on Aug. 10, 2020 by Jack Duplechain, and also claims benefit of, and priority to, U.S. Provisional Patent Application No. 62/965,127, filed on Jan. 23, 2020 by Jack Duplechain. The contents of each are incorporated by reference their entireties, for all purposes.

FIELD OF THE DISCLOSURE

The present invention relates to an exercise apparatus, and more particularly, to a transformable and multi-purpose exercise or gym apparatus that transforms or converts into furniture, the exercise apparatus that combines exercise equipment with furniture to give an unprecedented home exercise experience to a user.

BACKGROUND OF THE INVENTION

A complaint regarding living spaces and work spaces, is that there is not enough room for the various types of furniture and apparatus that an individual may want in a specific room. One problem is that more people are living in smaller homes and apartments, and furniture is often designed only for a single purpose (e.g. a desk for work, a dining table for eating, a bed for sleeping). Another example of single purpose piece of equipment is an exercise machine, which, similar to furniture, takes up a lot of space. Unless a person lives in a home with a surplus of square footage, a home exercise machine may not be a viable option. Lack of space for an exercise machine has led many people to join private gyms. However, membership at a private gym is not a luxury that every person can afford.

One way that people have tried to solve the problem of lack of space for an exercise machine is by utilizing machines that can convert into other pieces of furniture. Several exercise apparatuses that convert to perform a number of different exercises have been disclosed in the past. One such example is disclosed in a U.S. Pat. No. 7,591,763, entitled "Portable convertible multifunction exercise apparatus and method" ("the '763 Patent"). The '763 Patent discloses a portable, convertible and multifunction exercise apparatus that uses a single platform that has selectively length adjustable resistance bands. Rotatable spring biased wheels can lock the bands to different lengths, where the longer the length, the less resistance, and the shorter the length the greater the resistance. The platform can transform from a stepper, into a bench, into an incline seat with foldable legs. Contained within the platform storage unit are several bar handles and leg attachments. An exercise bar having a rotatable midportion can have handle grip ends removably attachable to the bands and/or the bar, so that a variety of additional exercises can be performed, allowing the user to exercise all muscle groups for a total body workout.

Another example is disclosed in a U.S. Pat. No. 9,682,307, entitled "Exercise Equipment with Integrated Desk" ("the '307 Patent"). The '307 Patent discloses an exercise apparatus that includes a desk with a working surface.

However, the apparatus is limited to positioning a desk surface on a treadmill and cannot be used a strength training apparatus.

The above discussed disclosures provide convertible and multifunction exercise apparatuses that allow individuals to accomplish their fitness, health conditioning, weight loss and rehabilitation goals with a single multipurpose apparatus. However, they cannot be used as typical non-workout furniture. Therefore, there is a need for an improved workout or exercise apparatus that provides increased functionality and utilization of space as compared to that of above-identified disclosures, and that combines an exercise apparatus with furniture to give users an unprecedented home exercise experience.

BRIEF SUMMARY OF THE PRESENT INVENTION

The present invention seeks to provide a solution to the problems outlined above by providing an exercise apparatus that transforms into furniture and different gym equipment.

In one aspect of the present invention, a transformable exercise apparatus converts into furniture and different types of gym equipment to give users an unprecedented home exercise experience. The transformable exercise apparatus has a main frame. The main frame has a pair of base arms arranged substantially parallel to each other, a pair of front legs extending substantially perpendicular from the pair of base arms, a pair of rear legs extending substantially perpendicular from the pair of base arms, and a pair of top arms, each of the pair of top arms connecting respective pair of front legs and pair of rear legs. The exercise apparatus also includes a plurality of telescopic members stored in the pair of front legs, and a first table top and a second table top. The second table top comprises collapsible legs. The collapsible legs fold and allow for placing the second table top and the first table top over the pair of top arms, thereby transforming the exercise apparatus into a furniture. The second table top is capable of demounting from the pair of top arms, wherein the collapsible legs extend from a collapsed configuration for placement on the pair of top arms, to an expanded configuration for placement on a ground, thereby and transforming the second table top into a workbench. The plurality of telescopic members extend from the front legs, and the plurality of telescopic members receive a pull-up bar at the top, thereby transforming the exercise apparatus into a pull up exercise apparatus.

The exercise apparatus includes base arms placed parallel to each other. The exercise apparatus further includes front legs and rear legs extending from the base arms. The exercise apparatus includes top arms, each connecting respective front and rear leg of each base arm. The exercise apparatus presents a plurality of telescopic members that store in the front legs. The exercise apparatus includes a first table top and a second table top. The second table top encompasses collapsible legs. The collapsible legs fold and allow for placing the second table top and the first table top over the top arms transforming the exercise apparatus into a furniture. The second table top demounts from the top arms, expands the collapsible legs and positions on the ground transforming the second table top into a workbench (such as for laying on for doing bench press exercises). The telescopic members extend and includes a pull-up bar at the top, transforming the exercise apparatus into a pull-up exercise apparatus.

In another aspect of the present invention, the base arms include an additional base arm that mounts perpendicularly to the base arms. The additional base arm includes a center rear leg having a slidable sleeve with a weight bearing projection. The weight bearing projection receives weights. One of the rear legs stores a L-shaped arm and the other stores an elongated arm. The L-shaped arm includes a pulley having a cable, in which one end encompasses a hand grip and the other end mounts to the slidable sleeve. The elongated arm mounts over the center rear leg and the L-shaped arm mounts over the elongated arm transforming the center rear leg, the elongated arm and the L-shaped arm into a lat pull-down exercise apparatus.

In another aspect of the present invention, the top arms provide rails that receive a U-shaped bar. The U-shaped bar presents a foot bar configured to slide along the U-shaped bar and includes weights. The U-shaped bar slides along the rails transforming the exercise apparatus into a leg press exercise apparatus.

In one advantageous feature of the present invention, the exercise apparatus converts into a furniture that looks to the naked eye as an ordinary piece of furniture that keeps up with current design trends to appeal to the users' desire for an aesthetic living space. The exercise apparatus transforms into furniture and also into workout apparatus all the while using the same space. A user can use exercise apparatus for performing various exercises and avoid finding space for other products that must be stored in a closet or under a bed.

In another advantageous feature of the present invention, the exercise apparatus transforms or converts from furniture to exercise equipment in a quick and efficient way. For example, when the user wants to use the exercise apparatus as a bench press, the table top can convert quickly into a bench, and pop pins allow for quick assembly of the barbell/squat rack.

The exercise apparatus operates as various kinds of gym quality exercises and gym machines and also integrates into the design of the furniture so that when the furniture is in its home state, it does not appear as exercise equipment, and/or the exercise parts will supplement the furniture. The exercise apparatus encompasses movable and/or detachable parts and pieces that manipulate to convert into an exercise equipment. The conversion from furniture to exercise equipment is quick and efficient.

In yet another advantageous feature of the present invention, the exercise apparatus is not hidden away, and by simply and quickly converting the exercise apparatus into a workout apparatus, the user can use the space where the furniture already exists. The exercise apparatus can be used in smaller spaces while ensuring rest of the home's ambiance clean and at the same time exercise on authentic exercise machines, and have it convert back to designer quality furniture.

In yet another advantageous feature of the present invention, the exercise apparatus eliminates the need for a user to attain a separate gym equipment for exercising and separate furniture. This saves space for the user in the room or office.

Features and advantages of the subject matter hereof will become more apparent in light of the following detailed description of selected embodiments, as illustrated in the accompanying FIGUREs. As will be realized, the subject matter disclosed is capable of modifications in various respects, all without departing from the scope of the subject matter. Accordingly, the drawings and the description are to be regarded as illustrative in nature.

BRIEF DESCRIPTION OF THE DRAWINGS

Further features and advantages of the present subject matter will become apparent from the following detailed description, taken in combination with the appended drawings, in which.

DETAILED DESCRIPTION OF EMBODIMENTS

Figure 1:
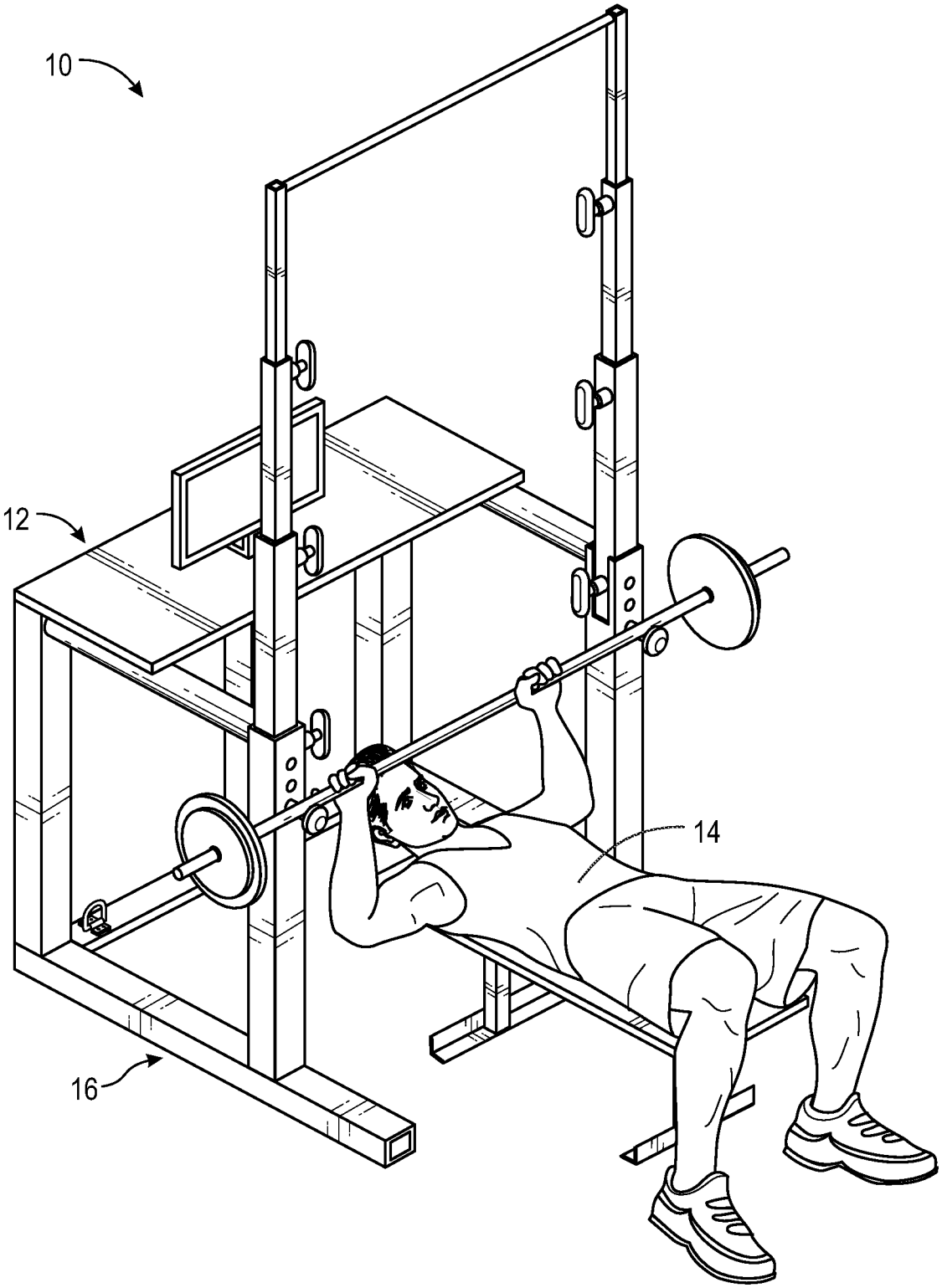
FIG. 1 depicts an exemplary environment in which a user uses an exercise apparatus that transforms into a furniture and different workout apparatus, in accordance with one embodiment of the present invention.

The invention now will be described more fully hereinafter with reference to the accompanying drawings, in which embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section.

It will be understood that the elements, components, regions, layers and sections depicted in the figures are not necessarily drawn to scale.

The terminology used herein is for the purpose of describing particular embodiments only, and is not intended to be limiting of the invention. As used herein, the singular forms "a," "an," and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," "upper" or "top," "left" or "right," "above" or "below," "front" or "rear," may be used herein to describe one element's relationship to another element as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. The numbers, ratios, percentages, and other values may include those that are ±5%, ±10%, ±25%, ±50%, ±75%, ±100%, ±200%, ±500%, or other ranges that do not detract from the spirit of the invention. The terms about, approximately, or substantially may include values known to those having ordinary skill in the art. If not known in the art, these terms may be considered to be in the range of up to ±5%, ±10%, or other value higher than these ranges commonly accepted by those having ordinary skill in the art for the variable disclosed. Thus, embodiments of the present invention should not be construed as limited to the particular shapes of regions illustrated herein but are to include deviations in shapes that result, for example, from manufacturing. The invention illustratively disclosed herein suitably may be practiced in the absence of any elements that are not specifically disclosed herein.

Figure 2:
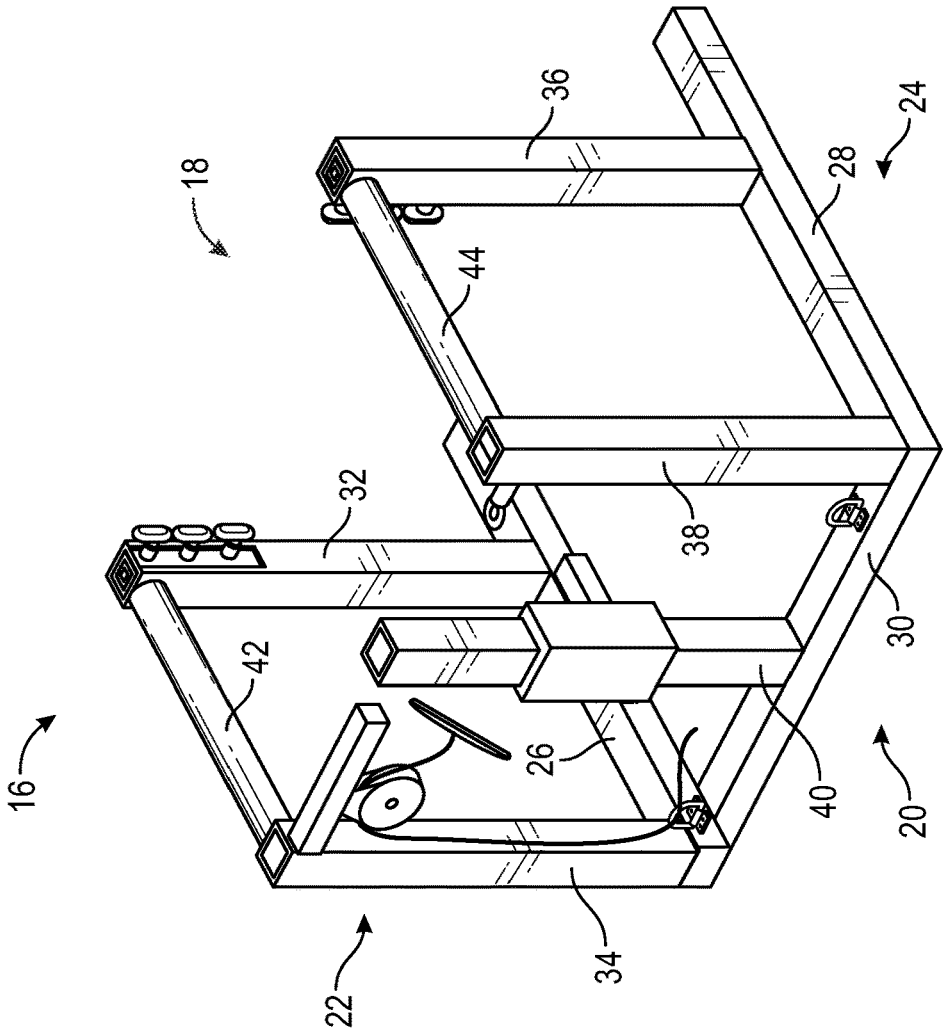
FIG. 2 shows a rear side perspective view of a main frame of the exercise apparatus.

Turning to the Figures, FIG. 1 shows an exemplary environment 10 of exercise apparatus 12 that converts into furniture and exercise apparatus, in accordance with one embodiment of the present invention. Exercise apparatus 12 converts into furniture for use as furniture for work, or a table for eating and into a workout or gym apparatus for accomplishing fitness, health conditioning, weight loss and rehabilitation goals. FIG. 1 shows user 14 using exercise apparatus 12 to exercise. Exercise apparatus 12 includes main frame 16. FIG. 2 shows a rear side perspective view of main frame 16, in accordance with one embodiment of the present invention. Main frame 16 includes first end 18, second end 20, first side 22 and second side 24. First end 18 indicates a front end of main frame 16. Second end 20 indicates a rear end of main frame 16. First side 22 indicates a right side of main frame 16. Second side 24 indicates a left side of main frame 16. At first side 22, main frame 16 presents first base arm 26. (As a matter of convenience, elements described as "arms" are horizontal support members, and "legs" are vertical support members, as shown and described throughout the specification). At second side 24, main frame 16 presents second base arm 28. A person skilled in the art understands that first base arm 26 and second base arm 28 act as base frames for main frame 16. At second end 20, main frame 16 presents additional base arm i.e., third base arm 30. Third base arm 30 mounts perpendicularly to first base arm 26 and second base arm 28 using connection mechanisms such as welding, fasteners or any other known connection mechanisms. Each of first base arm 26, second base arm 28 and third base arm 30 provides a material made of metal, wood, hard plastic or any other material. Metal is preferred as it withstands the weight of user 14 when he/she is exercising or using exercise apparatus 12 as furniture. The first base arm 26 and second base arm 28 form a pair of base arms 26, 28 arranged substantially parallel to each other. As shown throughout the figures, first base arm 26 and second base arm 28 are sized to extend past the square or rectangular shape of the other arms and legs on the main frame 16. This extension provides for better stability of exercise apparatus 12, especially when used for pull-up, where the user's weight may cause the exercise apparatus 12 to tip over if there is not an extended base support. However, an extended base support may also be accomplished by having additional base arm inserts (not shown) that can be housed and extended from first base arm 26 and second base arm 28.

From the above, it is evident that first base arm 26 and second base arm 28 mount substantially parallel to each other, and third base arm 30 mounts perpendicularly to first base arm 26 and second base arm 28. First base arm 26, second base arm 28 and third base arm 30 form a letter "U" shape and act as a base (or base arms) for main frame 16. Each of first base arm 26, second base arm 28 and third base arm 30 comes in a variety of shapes e.g., in an elongated rectangular or a cylindrical configuration.

First base arm 26 provides first leg 32 and second leg 34. As can be seen, first leg 32 is at first end 18 and second leg 34 is at second end 20. First leg 32 and second leg 34 extend perpendicularly from first base arm 26. Similarly, second base arm 28 provides third leg 36 and fourth leg 38. As can be seen, third leg 36 is at first end 18 and fourth leg 38 is at second end 20. Third leg 36 and fourth leg 38 extend perpendicularly from second base arm 28. Further, third base arm 30 provides fifth leg 40 extending from its center. Each of first leg 32, second leg 34, third leg 36, fourth leg 38 and fifth leg 40 comes in a variety of shapes e.g., in an elongated rectangular or a cylindrical configuration. As can be seen, first leg 32 and third leg 36 act as front legs of main frame 16. Further, second leg 34 and fourth leg 38 (and/or fifth leg 40, shown as a center rear leg) act as rear legs of main frame 16. In one example, first leg 32 and third leg 36 mount at a distance from the far end of first base arm 26 and second base arm 28, respectively to provide stability and counterbalance for main frame 16. Each of first leg 32, second leg 34, third leg 36, fourth leg 38 and fifth leg 40 provides a material made of metal, wood, hard plastic or any other suitable material. Each of first leg 32, second leg 34, third leg 36, fourth leg 38 and fifth leg 40 encompasses a hollow structure and has about the same height.

Main frame 16 further presents first top arm 42 connecting first leg 32 and second leg 34. First top arm 42 connects first leg 32 and second leg 34 using a variety of connecting mechanisms such as welding, fasteners, for example. Similarly, main frame 16 presents second top arm 44 connecting third leg 36 and fourth leg 38. Second top arm 44 connects third leg 36 and fourth leg 38 using a variety of connecting mechanisms such as welding, fasteners, for example. As can be seen, first top arm 42 mounts substantially parallel to first base arm 26 and second top arm 44 mounts substantially parallel to second base arm 28. Together with first leg 32, second leg 34, third leg 36, fourth leg 38, first base arm 26, second base arm 28 and third base arm 30; first top arm 42 and second top arm 44 form a base structure for exercise apparatus 12 for use as a workout apparatus and/or furniture. A person skilled in the art understands that first top arm 42 and second top arm 44 act as top arms of main frame 16. The first top arm 42 and the second top arm 44 form a pair of top arms 42, 44, each of the pair of top arms connecting respective pair of front legs and pair of rear legs, and are substantially parallel to each other. The top arms 42, 44 can be of a variety of shapes, however, in a preferred embodiment the top arms 42, 44 are cylindrical in shape so that a user gripping the arms 42, 44 (such as when doing a tricep dip exercise) will not have to grip any hard corners.

Each of first leg 32, second leg 34, third leg 36, and fourth leg 38 (and/or fifth leg 40 stores additional components for converting exercise apparatus 12 into a variety of workout or gym apparatus, in accordance with one embodiment of the present invention. This allows exercise apparatus 12 to utilize only that surface area already occupied by main frame 16 and saves space in a room. The first leg 32 and third leg 36 form a pair of front legs extending substantially perpendicular from the pair of base arms 26, 28 at the first end of the main frame 16. The second leg 34 and fourth leg 38 form a pair of rear legs extending substantially perpendicular from the pair of base arms 26, 28 at the end of the main frame 16. The first leg 32 and second leg 34 are substantially parallel to each other and are on the right side of the main frame 16. The third leg 36 and the fourth leg 38 are substantially parallel to each other and on the left side of the main frame 16.

Figure 3B:
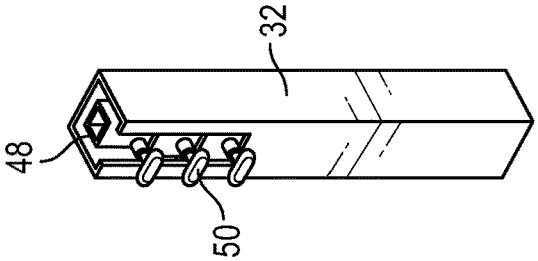
FIGS. 3A and 3B show an exploded and a perspective view of a first (front) leg, respectively.
Figure 3A:
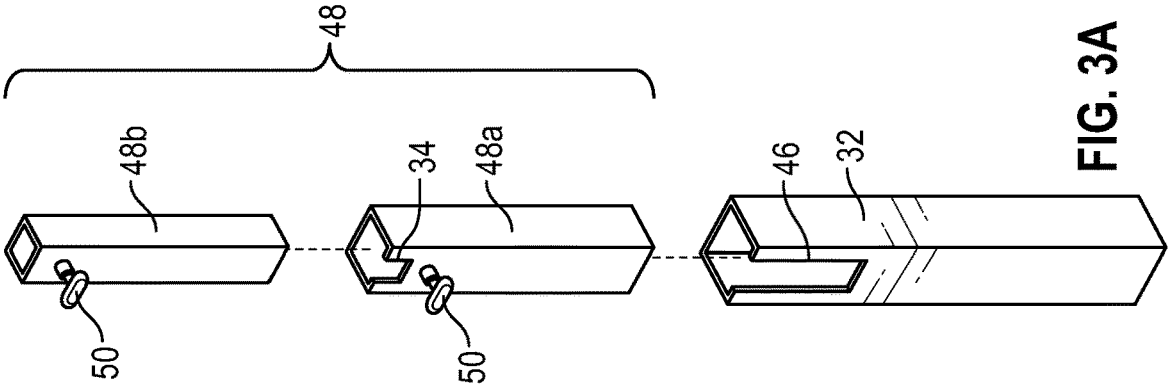
Figure 11:
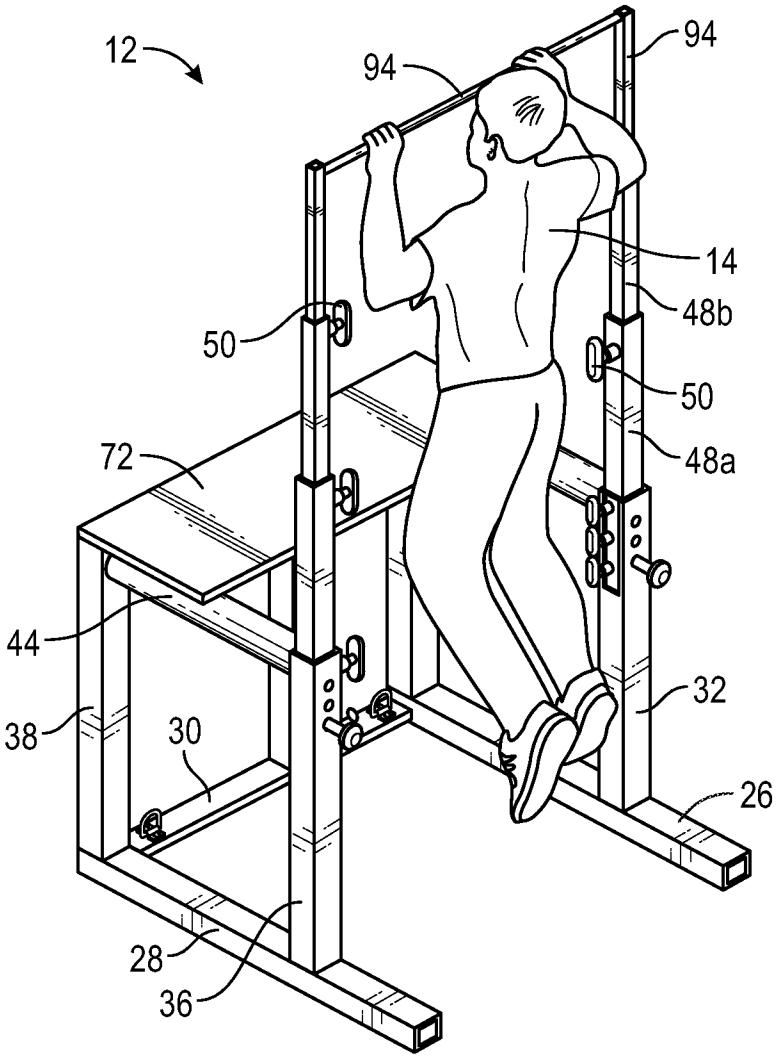
FIGS. 11 and 12 show exemplary embodiments in which a user performs pull-up bar exercises by adjusting the height of the pull-up bar exercise apparatus.
Figure 10:
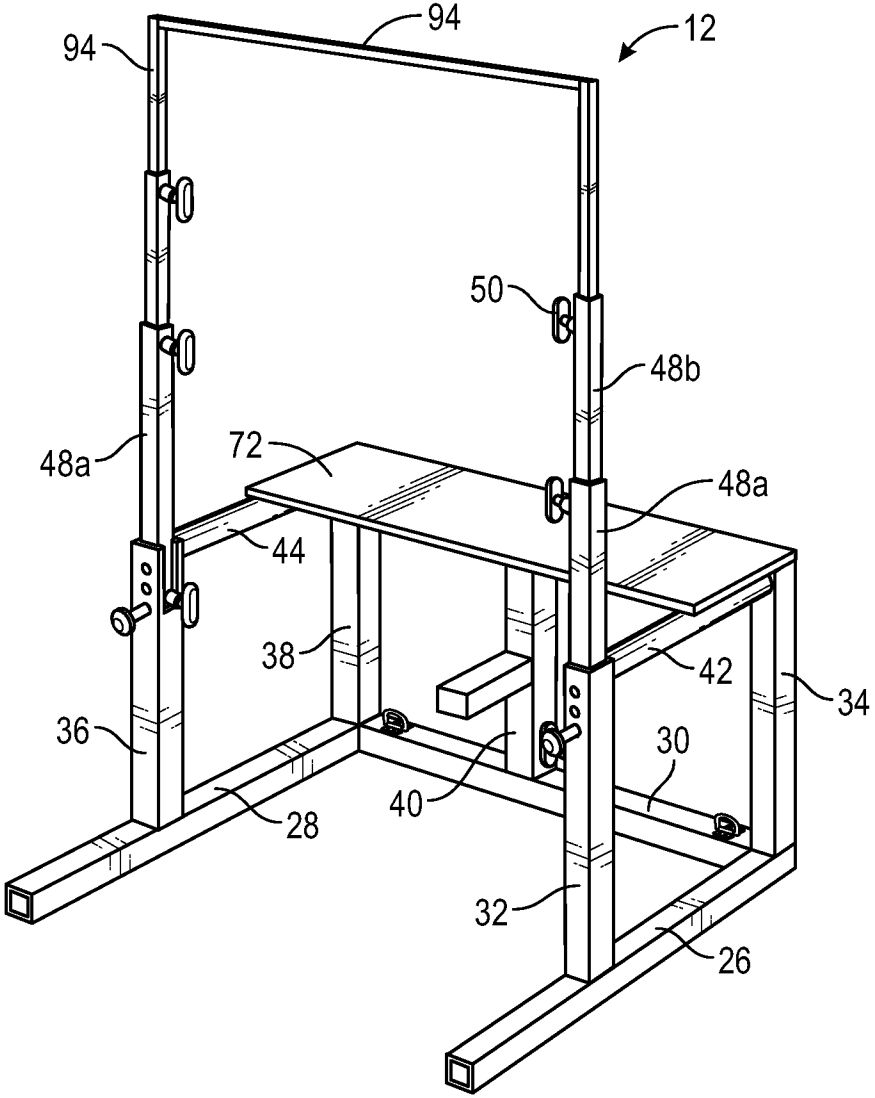
FIG. 10 shows a front perspective view of an exercise apparatus transformed into a pull-up bar exercise apparatus, in accordance with one embodiment of the present invention.
Figure 12:
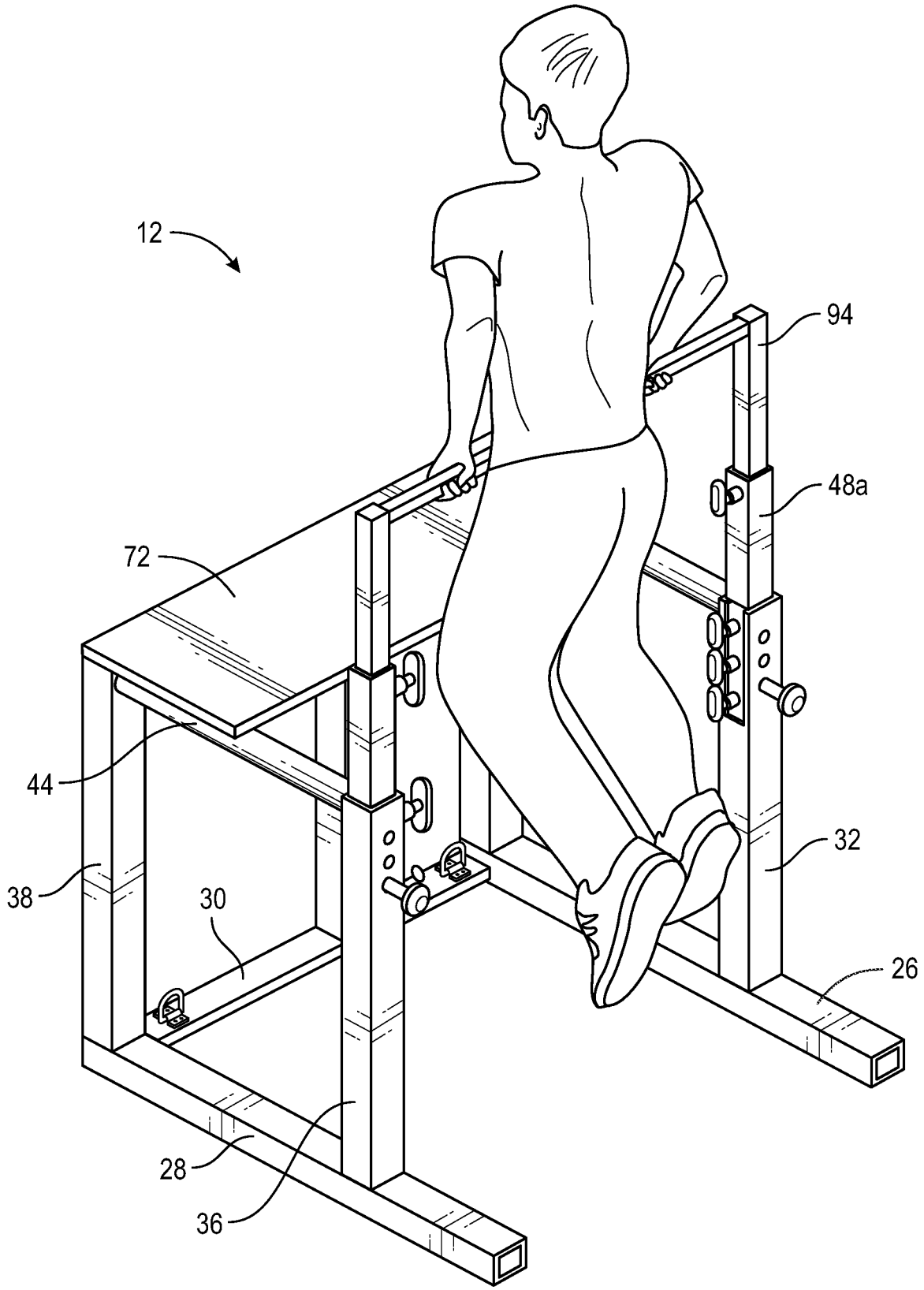

FIG. 3A through 5 show constructional features of first leg 32, second leg 34, third leg 36, fourth leg 38 and fifth leg 40. FIG. 3A shows an exploded view of first leg 32 encompassing a plurality of telescopic members 48, in accordance with one embodiment of the present invention. As specified above, first leg 32 comes in an elongated rectangular configuration. In one implementation, first leg 32 provides cut section 46 at the top. Here, first leg 32 encompasses first telescopic member 48*a* and second telescopic member 48*b*. First telescopic member 48*a* and second telescopic member 48*b* progressively decrease in size and come in the same shape as that of first leg 32. Here, first leg 32 receives first telescopic member 48*a*, and first telescopic member 48*a* receives second telescopic member 48*b* thereby saving space. FIG. 3B shows a feature of second telescopic member 48*b* sitting inside first telescopic member 48*a*, which in turn sits in first leg 32. Each of first telescopic member 48*a*, second telescopic member 48*b* and first leg 32 includes pin 50 for connecting them together. Pins may be any kind of projection that secures two movable into a locked position. One type of pin often used in exercise equipment is a pop pin. Pins 50 help to join first telescopic member 48*a* and second telescopic member 48*b* to first leg 32 without having to pull them wholly out of first leg 32. Pins 50 allow to adjust length of first telescopic member 48*a* and connect to first leg 32 (FIGS. 10 and 12). Similarly, pin 50 allows to adjust length of second telescopic member 48*b* into and first telescopic member 48*a* (FIGS. 10 and 12). For ease of reference, telescopic member 48*a* and second telescopic member 48*b*, collectively termed as telescopic members 48 hereinafter. Similarly, third leg 36 encompasses telescopic members 48 and pins 50, as explained above. Telescopic members 48 together with first leg 32 and third leg 36 allow user 14 to perform pull up exercises using exercise apparatus 12 (FIGS. 11 and 12).

Figure 4:
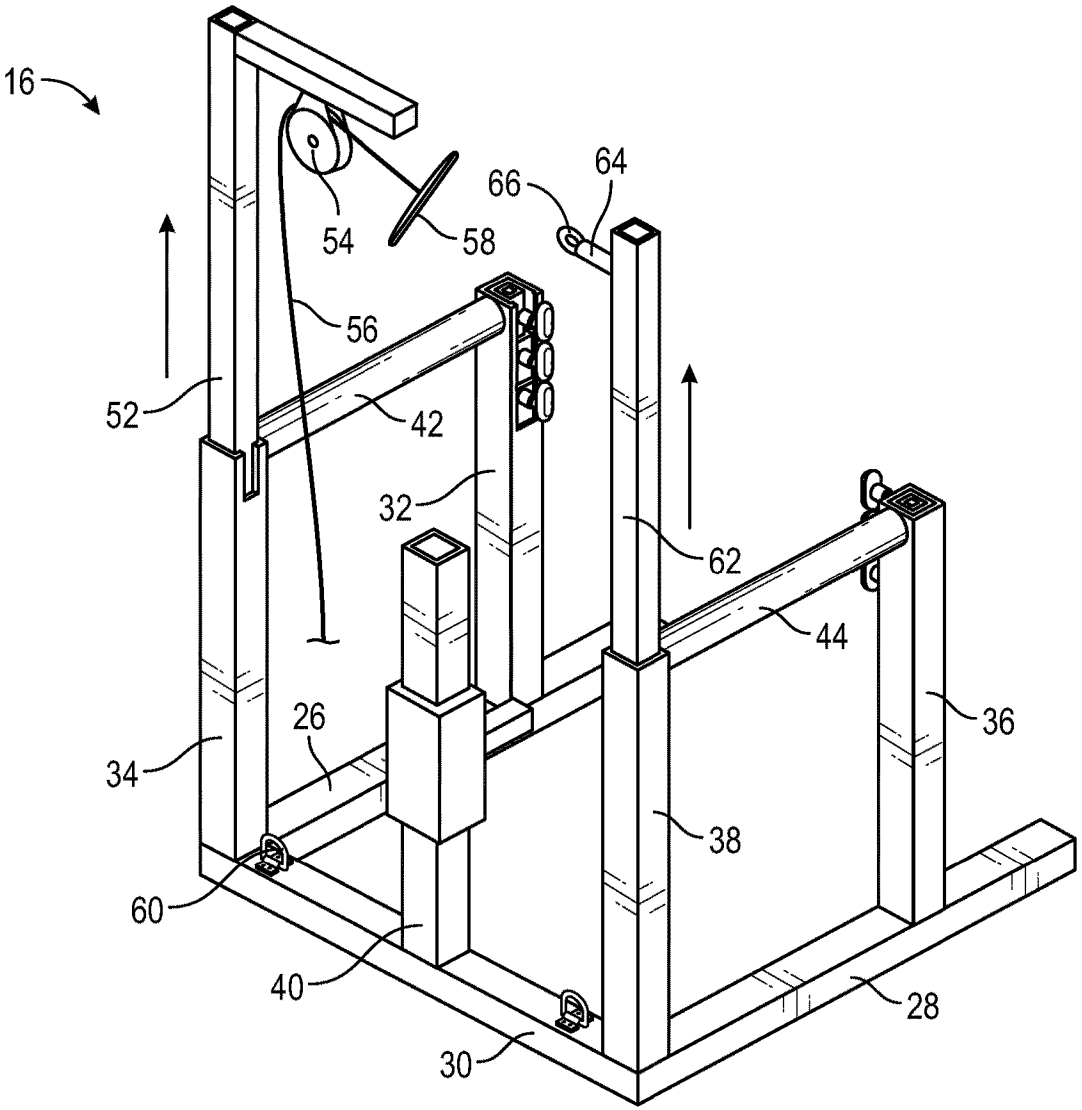
FIG. 4 depicts a feature of rear legs storing additional components allowing the exercise apparatus for use as a lat pull-down exercise; in accordance with one embodiment of the present invention.
Figure 16:
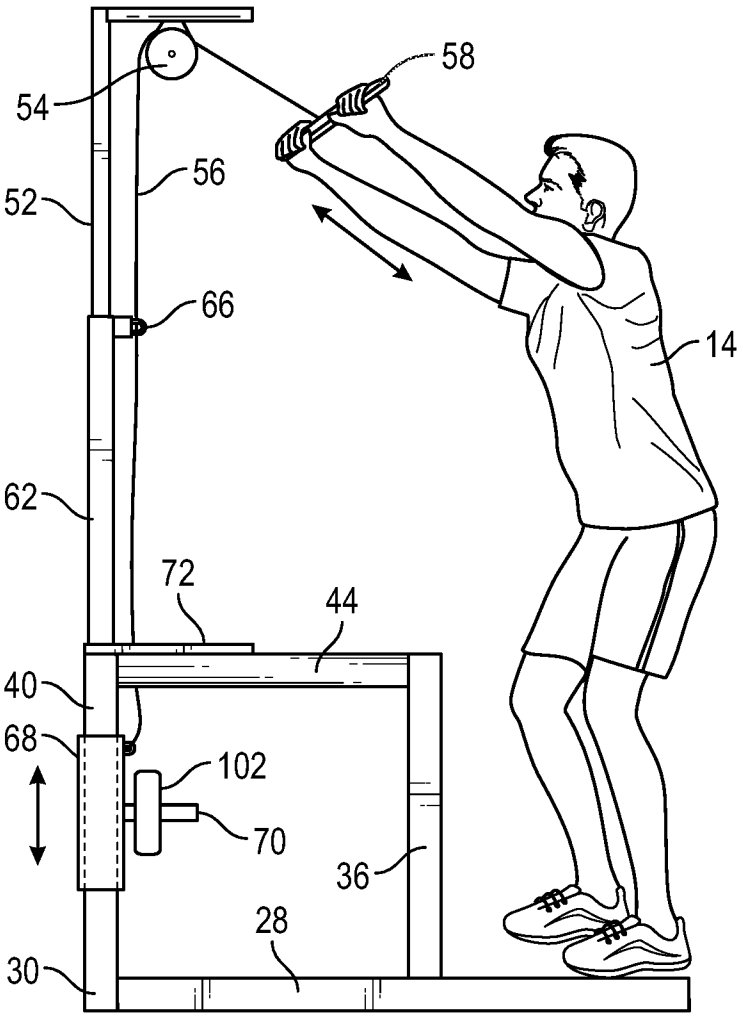

FIG. 4 shows a feature of second leg 34 and fourth leg 38 storing additional components allowing exercise apparatus 12 for use as a lat pull-down exercise, tricep pushdown or tricep pulldown or rope tricep pushdown apparatus, in accordance with one embodiment of the present invention. Second leg 34 encompasses L-shaped arm 52. In one implementation, second leg 34 receives the longer section of L-shaped arm 52 such that the shorter section extends perpendicularly to the longer section of L-shaped arm 52 and faces fifth leg 40. In one example, L-shaped arm 52 presents pulley 54 that receives cable 56 at the top i.e., at the shorter section of L-shaped arm 52. Cable 56 provides hand grip 58 at one end and other end connects to hooks 60 (FIG. 6) provided at third base arm 30 when not in use. Alternatively, hooks 60 help to attach elastic bands (not shown) allowing user 14 to perform stretch cord exercises. Further, fourth leg 38 encompasses elongated arm 62 having the same length to that of the longer section of L-shaped arm 52. Elongated arm 62 includes rod 64 extending perpendicularly from elongated arm 62 at the top. In one example, rod 62 encompasses loop 66 for receiving cable 56 during use as a lat pull-down exercise (FIG. 16).

Figure 5:
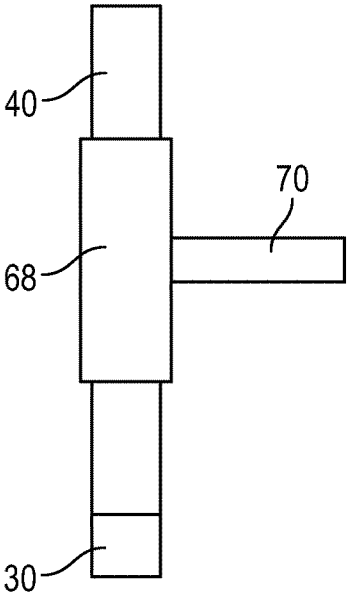
FIG. 5 depicts a side view of a center rear leg.

FIG. 5 shows a side view of fifth leg 40, in accordance with one embodiment of the present invention. Fifth leg 40 provides slidable sleeve 68 surrounding a portion of fifth leg 40. Sleeve 68 provides weight bearing projection 70 that extends perpendicularly from fifth leg 40 facing first end 18. Sleeve 68 slides along the length of fifth leg 40 while retaining weight bearing projection 70.

As specified above, exercise apparatus 12 allows for use as furniture and workout apparatus. In order to use exercise apparatus 12 as furniture, exercise apparatus 12 presents first table top 72 and second table top 74. First table top 72 includes a platform or desk made of hard plastic, wood, metal or any other suitable material. First table top 72 presents a rigid or semi-rigid material having suitable strength and thickness. First table top 72 is capable of withstanding external pressure or weight of items including weight of user 14 without breaking or deformation. First table top 72 comes in a variety of shapes, including but not limited to, rectangular, square, oval or any other shape depending on the need. In one example, edges of first table top 72 are rounded or provided in a curved manner to prevent user 14 from getting injured. Similarly, second table top 74 includes a platform made of hard plastic, wood, metal or any other suitable material. Second table top 74 presents a rigid or semi-rigid material having suitable strength and thickness. Second table top 74 is capable of withstanding external pressure or weight of items including weight of user 14 without breaking or deformation. Second table top 74 comes in a variety of shapes, including but not limited to, rectangular, square, oval or any other shape depending on the need. In one example, edges of Second table top 74 are rounded or provided in a curved manner to prevent user 14 from getting injured.

Figure 6:
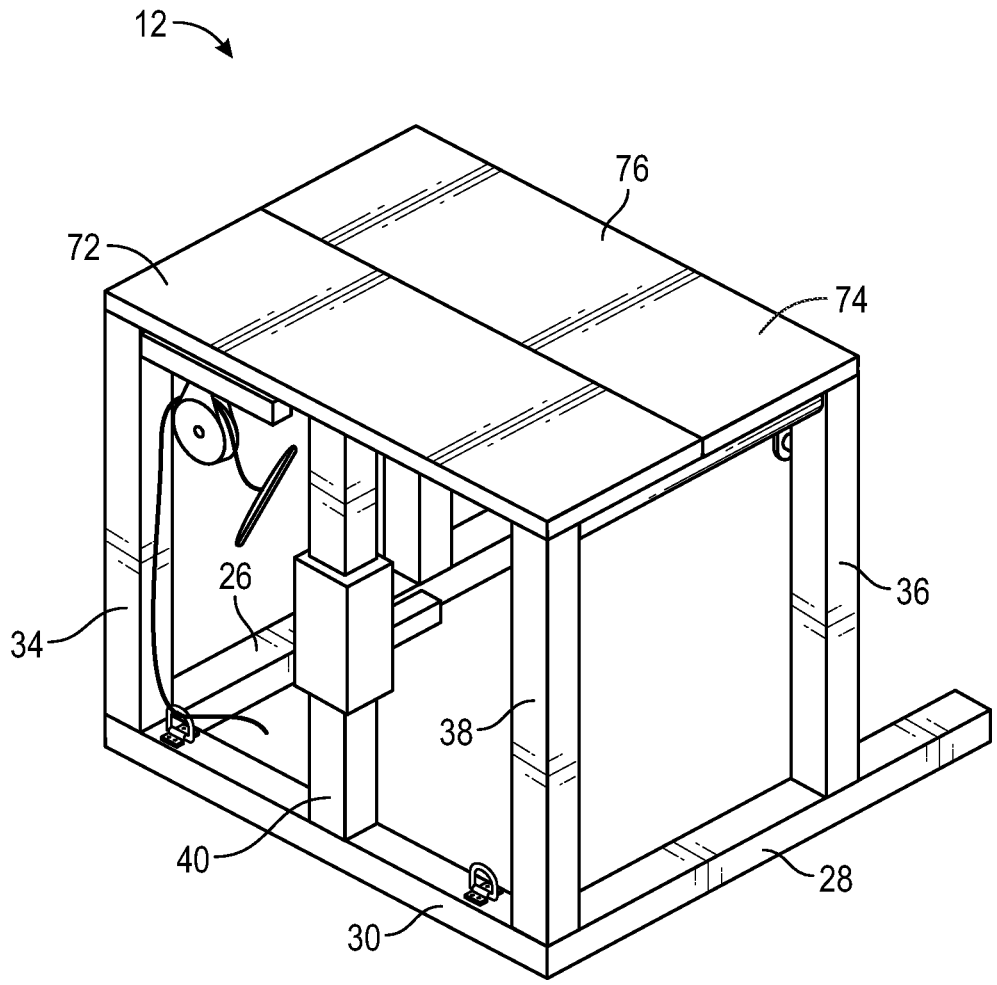
FIG. 6 shows an exemplary embodiment of an exercise apparatus transformed into a furniture, in accordance with one embodiment of the present invention.

FIG. 6 shows an exemplary embodiment in which first table top 72 and second table top 74 rest on first top arm 42 and second top arm 44 and allow user 14 to use exercise apparatus 12 as furniture. As can be seen, first table top 72 and second table top 74 rest on main frame 16 and form the shape of a table allowing user 14 to place items such as books, exercise accessories such as dumbbells, gloves, etc. In one example, first table top 72 and second table top 74 removably connect to first top arm 42 and second top arm 44 to have a stable structure for use as furniture.

Figure 7A:
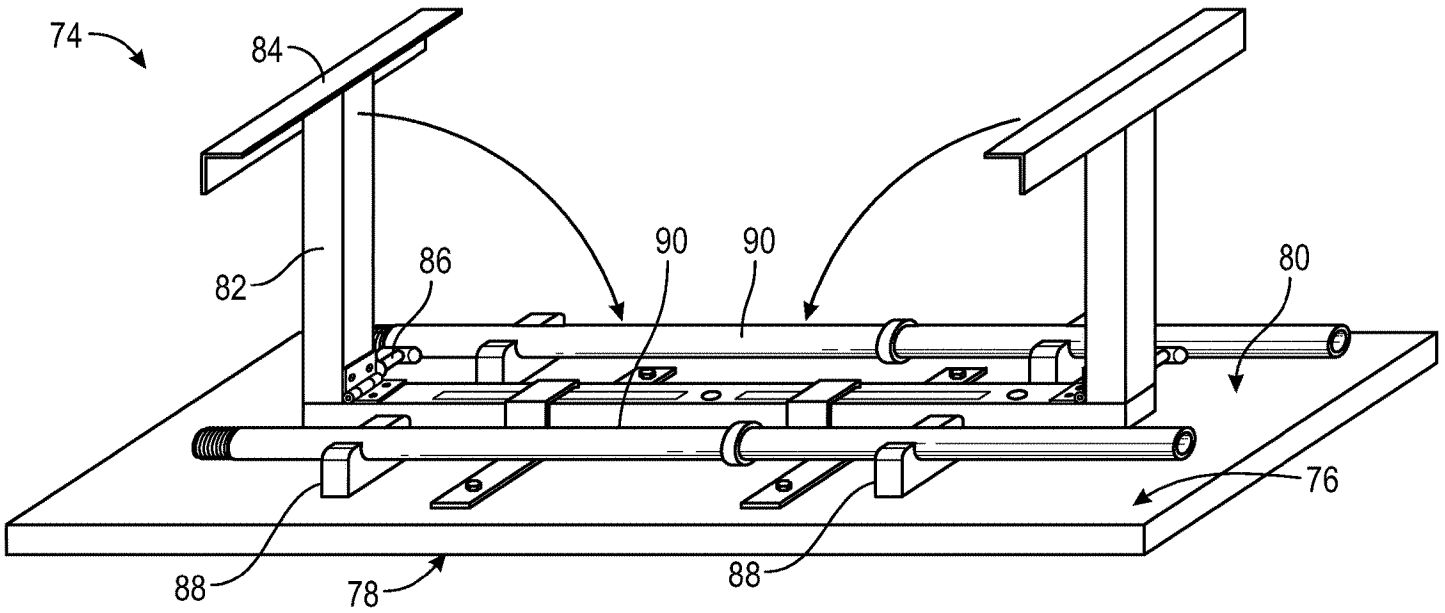
FIGS. 7A and 7B show a bottom perspective view of a second table top that transforms into a workbench in an expanded and folded position, respectively, in accordance with one embodiment of the present invention.
Figure 7B:
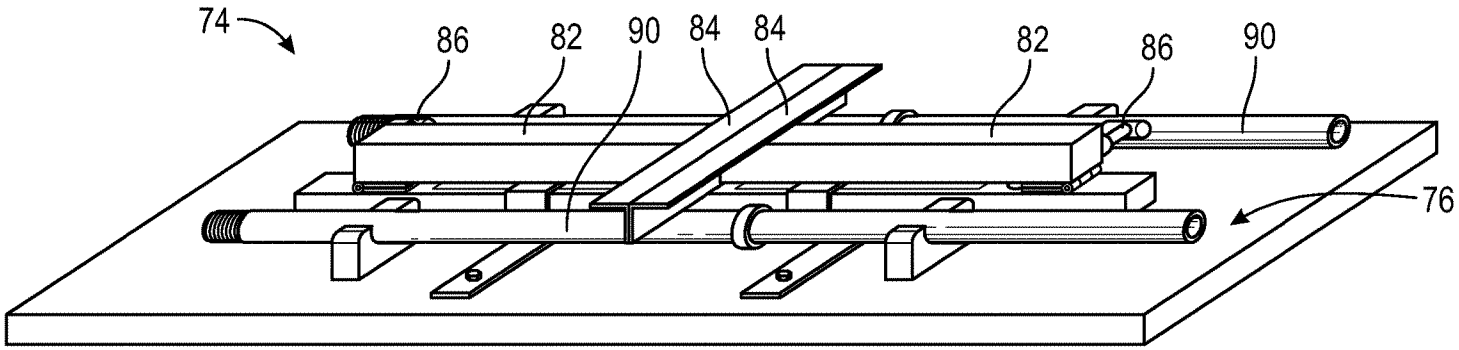
Figure 9:
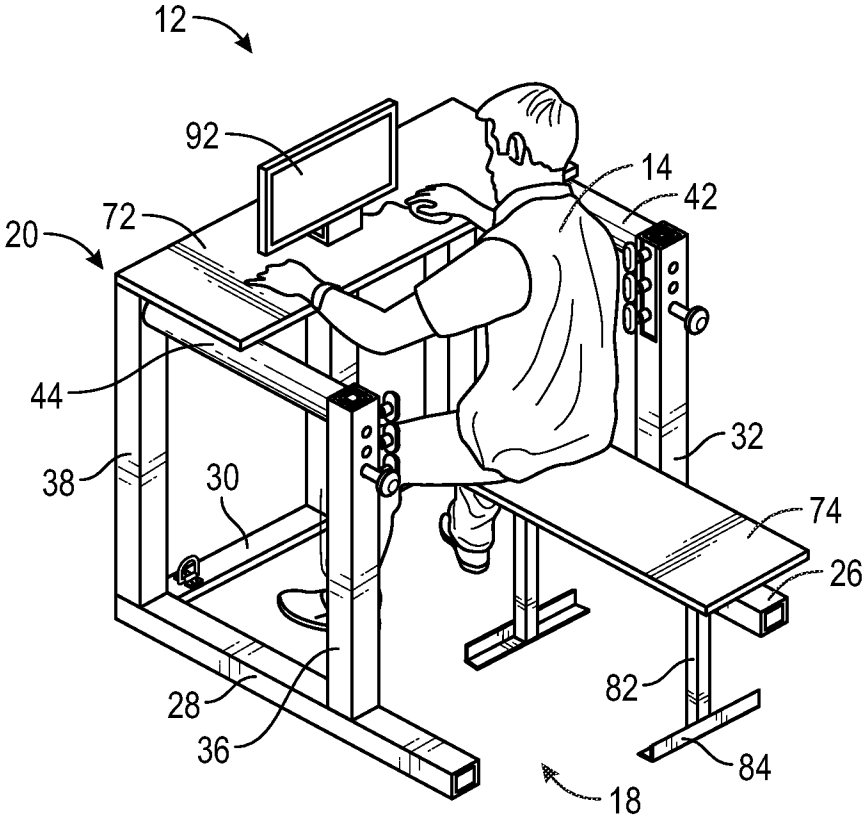
FIG. 9 shows an exemplary embodiment of the exercise apparatus transformed into a workstation.
Figure 8:
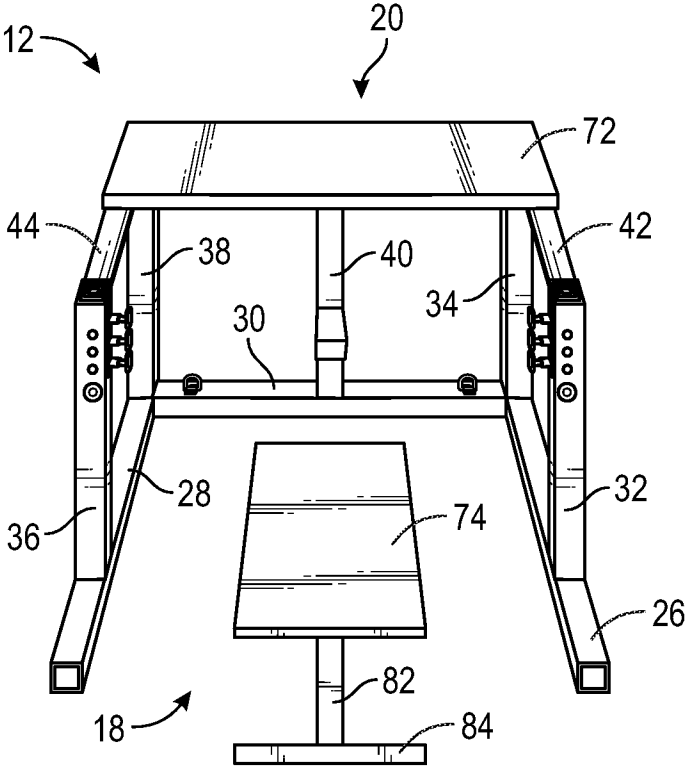
FIG. 8 shows a front perspective view of an exercise apparatus transformed into a furniture, e.g., coffee table, in accordance with one embodiment of the present invention.

In accordance with one embodiment of the present invention, user 14 uses second table top 74 as a chair or workbench for using exercise apparatus 12 as workout apparatus or as furniture, say as a dining table or work station, etc. FIG. 7A shows a bottom perspective view of second table top 74 that allows for use as a workbench. Second table top 74 includes platform 76 (flat structure, which may be hingedly connected) having top surface 78 and bottom surface 80. At bottom surface 80, second table top 74 presents support legs 82. A person skilled in the art understands that support legs 82 extend and/or fold at a hinge joint. FIG. 7A shows support legs 82 in a fully extended configuration for use as a workbench (FIGS. 8 and 9, for example). Each of support legs 82 presents L-shaped base 84 that rests on ground and provides required support for second table top 74. In one example, support legs 84 encompasses levers 86 that help to retain support legs 84 in the extended configuration or folded configuration. Further, platform 76 encompasses clips 88 for receiving rods 90. In one example, each rods 90 indicates a barbell bar (half barbell) that is stored underneath platform 76 when not in use. When needed, user 14 connects two halves rods 90 into a longer barbell bar (e.g., barbell bar 98 in FIGS. 13A and 13B) and attaches weights 100 to perform bench press exercise, as shown in FIG. 1. FIG. 7B shows support legs 82 in folded position which allows for placing second table top 74 over main frame 16 for use as furniture i.e., table (FIG. 6, for example).

FIG. 8 shows a front perspective view of exercise apparatus 12 for use as furniture, in accordance with one embodiment of the present invention. Here, second table top 74 in the form of workbench positions perpendicularly to main frame 14 and to first table top 72. As can be seen, first table top 72 covers half the portion of main frame 16 and allows space for user 14 to place his legs. Second table top 74 acts as a workbench when placed perpendicularly to main frame 14. FIG. 9 shows an exemplary embodiment in which user 14 places electronic device 92 on first table top 72 and operates electronic device 92 (work station) sitting on second table top 74. In one example, electronic device 92 includes an interactive software enabling or guiding user 14 to perform exercises, say a live interactive session with a fitness coach or trainer. Similarly, user 14 places food items on first table top 72 and uses exercise apparatus 12 as a dining table. Alternatively, user 14 places second table top 74 away from main frame 16 and uses second table top 74 for performing various other exercises. For example, user 14 rests on his back over second table top 74 and performs bench press exercises as known in the art. In another example, user 14 sits on second table top 74 and uses dumbbells (not shown) for muscle training. Alternatively, user 14 adjusts the length of support legs 82 thereby positioning the workbench at an inclination to perform inclined workbench exercises.

FIG. 10 shows a front perspective view of exercise apparatus 12 for use as a pull-up bar, in accordance with one embodiment of the present invention. Here, user 14 extends telescopic members 48 from first leg 32 and third leg 36. Subsequently, user 14 connects U-section member 94 at the top of telescopic members 48. User 14 adjusts the height of telescopic members 48 depending on the need. It should be understood that U-section member 94 acts as a pull-up bar which user 14 holds and suspends from for performing pull-up exercises or calisthenics for strength training. FIG. 11 shows an exemplary embodiment in which user 14 holds and suspends from U-section member 94 for performing pullup exercises. Here, user 14 holds onto U-section member 94 and lifts up his own bodyweight. User 14 repeats pull up action and the lifting action helps in building muscle as it provides a lot of stress on the user's body. Although FIG. 11 shows user 14 exercising while keeping first table top 72 over main frame 16, it is obvious to a person skilled in the art to remove first table top 72 from main frame 16 allowing user 14 to have more room to exercise without departing from the scope of the present invention.

FIG. 12 shows another embodiment of exercise apparatus 12 in which user 14 adjusts the telescopic members 48 to his shoulder height to perform straight bar dips exercise. Here, user 14 reduces the height of telescopic members 48 (by placing second telescopic member 48*b* into first telescopic member 48*a*) such that U-section member 94 comes at the user's shoulder height. Here, user 14 holds U-section member 94 at shoulder width with his arms fully extended. User 14 uses his body strength to hoist above U-section member 94 to perform straight bar dips. Repeating the straight bar dips help to engage and strengthen the triceps and chest for user 14. Although FIG. 11 shows user 14 exercising while keeping first table top 72 over main frame 16, it is obvious to a person skilled in the art to remove first table top 72 from main frame 16 allowing user 14 to have more room to exercise without departing from the scope of the present invention.

When not in use, user 14 removes U-section member 94 from telescopic members 48 and inserts into the hollow portion formed at first base arm 26 and second base arm 28 from first end 18 (not shown). A person skilled in the art understands that U-section member 94 mounts to first base arm 26 and second base arm 28 and utilizes only the surface area already occupied by first base arm 26 and second base arm 28 and saves space in a room.

Figure 13B:
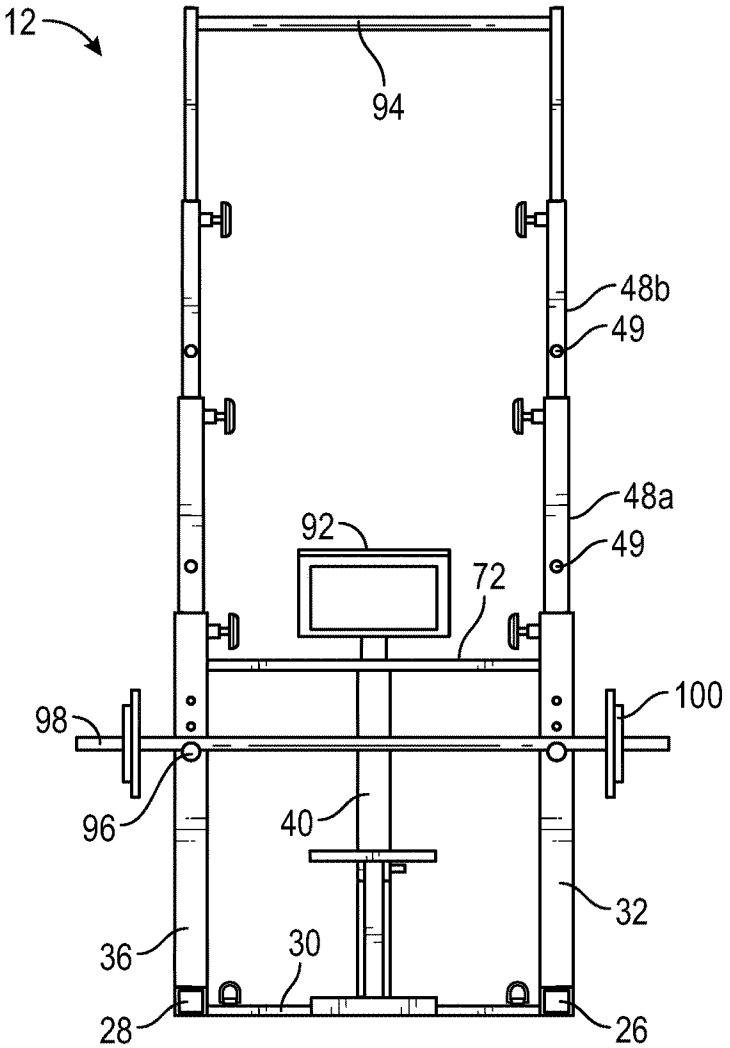
FIGS. 13A and 13B show the exercise apparatus transformed into a bell press exercise apparatus, in accordance with one embodiment of the present invention.
Figure 13A:
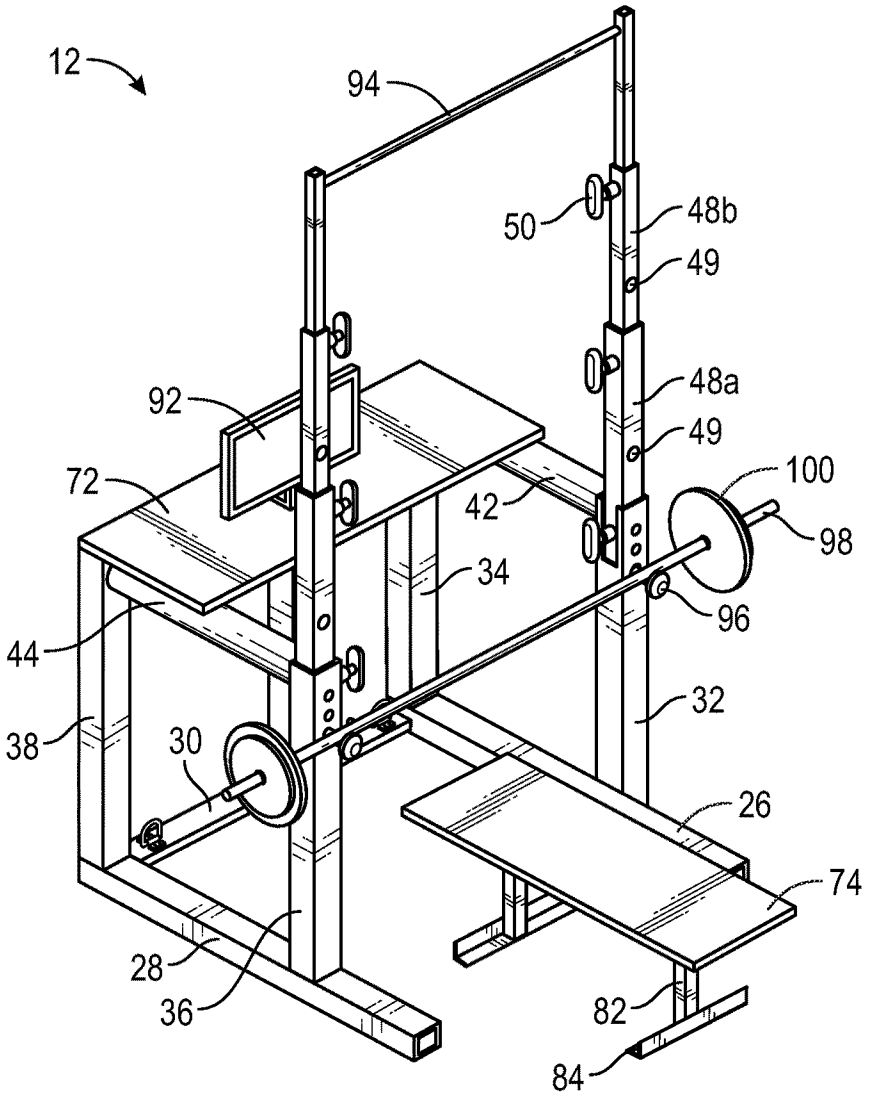

FIGS. 13A and 13B shows another embodiment of exercise apparatus 12 which allows user 14 to perform barbell press exercises, flat bench dumbbell press, etc. A person skilled in the art understands that FIGS. 13A and 13B show a perspective and a front view exercise apparatus 12 that allows user 14 to perform barbell press exercises and flat bench dumbbell press. In the current embodiment, each of first leg 32 and third leg 36 includes barbell holding projection 96 extending towards first end 18. Here, barbell holding projection 96 receives barbell bar 98. In one example, barbell bar 98 includes a combination of two rods 90 as shown in FIG. 7A. A person skilled in the art understands that exercise apparatus 12 allows to save space by storing rods 90 underneath second table top 74 as two halves of rods 90, when not in use. In one example, barbell bar 98 receives weights 100 from both sides depending on the need. By having barbell bar 98 on the middle part of main frame 16 i.e., first legs 32 and third legs 36, the base supports using the front and back parts equally. Because the support of the weights 100 are equally distributed on the base of the main frame 16, the need for base extenders can be eliminated. In some embodiments the telescoping members 48*a*, 48*b* may include additional pin holes 49 that can receive holding projections (such as pop pins) along various heights of the telescoping members 48*a*, 48*b*. This is advantageous if the user is doing squat exercises and wants the barbell 98 to rest at a higher position along the telescoping members 48*a*, 48*b*.

In order to perform barbell press exercise, user 14 lies on his back on second table top 74 as shown in FIG. 1, for example. User 14 holds barbell bar 98 with his hands slightly wider than his shoulder-width and presses his feet into the ground to push barbell bar 98 back up to return to starting position. Alternatively, user 14 removes barbell bar 98, lies on his back on second table top 74 and holds dumbbell in his hands to perform flat bench dumbbell press exercises. Similarly, user 14 performs other exercises with the help of second table top 74 (workbench) as known in the prior art.

Figure 14:
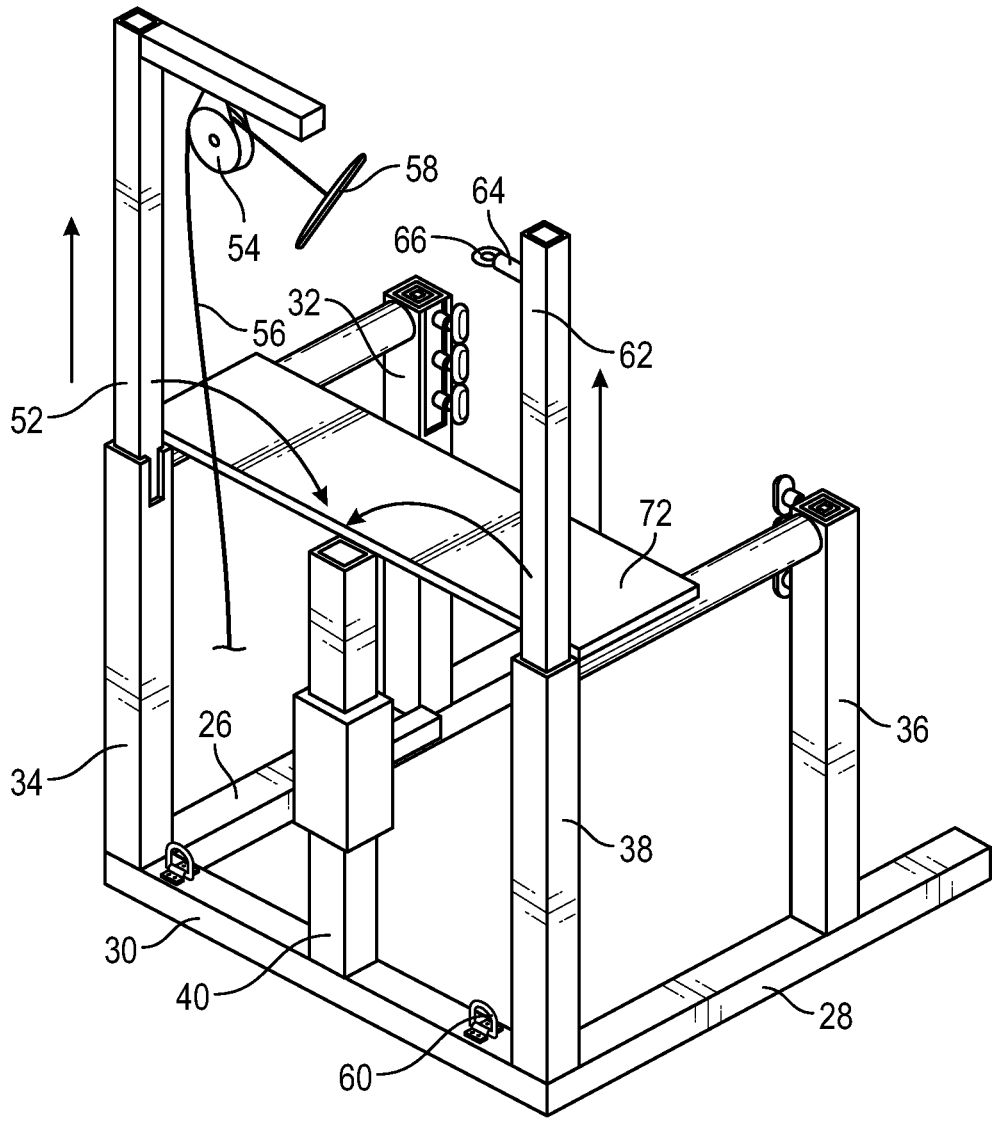
FIGS. 14, 15 and 16 show a feature of setting up the exercise apparatus into a lat pull-down exercise apparatus, in accordance with one embodiment of the present invention.
Figure 15:
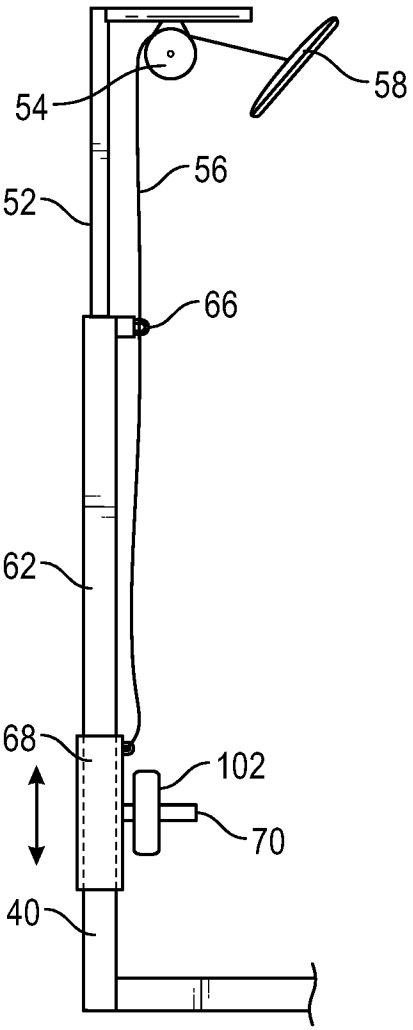

FIGS. 14, 15 and 16 show a feature of exercise apparatus 12 configured for performing a lat pull-down exercise. Prior to configuring exercise apparatus 12 for performing a lat pull-down exercise, L-shaped arm 52 and elongated arm 62 conceal inside second leg 34 and fourth leg 38, respectively as shown in FIG. 6 or FIG. 10. In order to configure exercise apparatus 12 for performing a lat pull-down exercise, at first, L-shaped arm 52 and elongated arm 62 emerge upwards. Subsequently, elongated arm 62 sits in fifth leg 40 and L-shaped arm 52 sits in elongated arm 62 at the top. FIG. 14 shows a feature of preparing elongated arm 62 to sit in fifth leg 40 and L-shaped arm 52 to sit in elongated arm 62. In other embodiments, instead of the L-shaped arm 52 being stored in one of the legs in the corners (as presently shown), the L-shaped arm 52 can be stored in the center leg (i.e. fifth leg 40). FIG. 15 shows a side view of fifth leg 40 connecting elongated arm 62 which in turn connects L-shaped arm 52. As specified above, L-shaped arm 52 presents pulley 54 for receiving cable 56 at the top. One end of cable 56 connects to hand grip 58. Further, cable 56 draws through loop 66 provided at rod 62 of elongated arm 62 and connects sleeve 68 surrounding fifth leg 40. As specified above, sleeve 68 provides weight bearing projection 70 that extends perpendicularly from fifth leg 40 facing first end 18. Here, weight bearing projection 70 receives weights 102 depending on the need. Weights 102 include barbell weights or square weights as known in the art. Alternatively, weights 102 include a unique table design with long slender weight bars, unlike the bulky standard weight.

In order to perform the lat pull-down exercise, user 14 holds hand grip 58 at the top as shown in FIG. 16. Subsequently, user 14 pulls hand grip 58 to his chest. Pulling hand grip 58 pulls cable 56 which in turn makes sleeve 68 to slide up along the length of fifth leg 40. Slider 68 slides up lifting weights 102 with the help of weight bearing projection 70. User 14 then takes hand grip 58 back to its original position under control which lowers sleeve 68 to its original position. User 14 repeats pulling and backing up hand grip 58 as needed. Alternatively, user 14 sits on second table top 74 (similar to FIG. 8) without placing first table top 72 on main frame 16. In such an implementation, user 14 holds hand grip 58 and pulls down hand grip 58 to his chest for performing underhand lat pull-down, wide-grip lat pull-down, unilateral lat pull-down, straight-arm pull-down, and close-grip lat pull-down to triceps press-down exercises. A person skilled in the art understands that pulley 54 works similar to a standard pulley system in a typical lat pull-down or pulley tower equipment.

Figure 17:
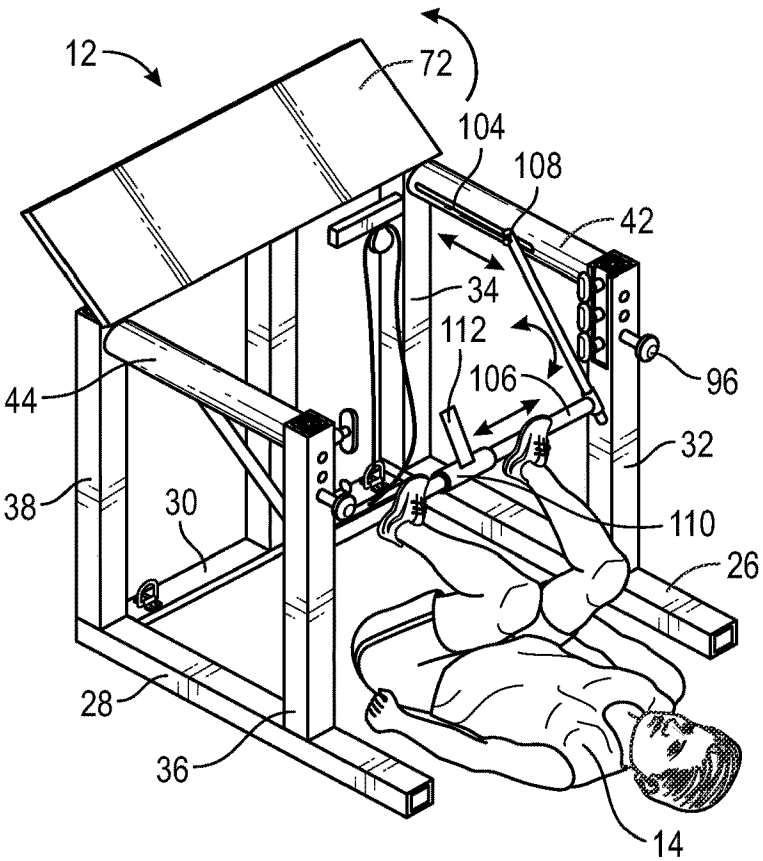
FIG. 17 shows a perspective view of the exercise apparatus set for use as a leg press workout apparatus, in accordance with one embodiment of the present invention; and, FIG. 18 shows a front view of the exercise apparatus in which the leg press workout apparatus setting is underneath the table top, in accordance with one embodiment of the present invention.

FIG. 17 shows a perspective view of exercise apparatus 12 for use as a leg press workout apparatus, in accordance with one embodiment of the present invention. FIG. 17 shows exercise apparatus 12 (leg press workout apparatus) in an operational configuration. In the present embodiment, each of first top arm 42 and second top arm 44 includes rail 104 facing each other. Rails 104 connect to U-shaped bar 106 via pin 108. Here, pins 108 rest within rails 104 and slide along rails 104 i.e., across the length of first top arm 42 and second top arm 44. U-shaped bar 106 presents foot bar 110 mounting around the perpendicular section of U-shaped bar 106. Foot bar 110 slides along the entire perpendicular section of U-shaped bar 106. In one example, foot bar 110 receives weight 112 similar to a sitting leg press found in a gym. Optionally, foot bar 110 connects to second table top 74 by two metal poles (not shown), similar to a mechanism found in the gym. Such an implementation includes an additional safety feature of releasing weight 112 from its racked position. In order to perform leg press exercise, user 14 lies on second table top 74 resting his feet against weight 112. User 14 pushes weight 112 with his legs which results in pins 108 sliding along rails 104. User 14 releases pressure allowing U-shaped bar 106 to come to its original position.

Figure 18:
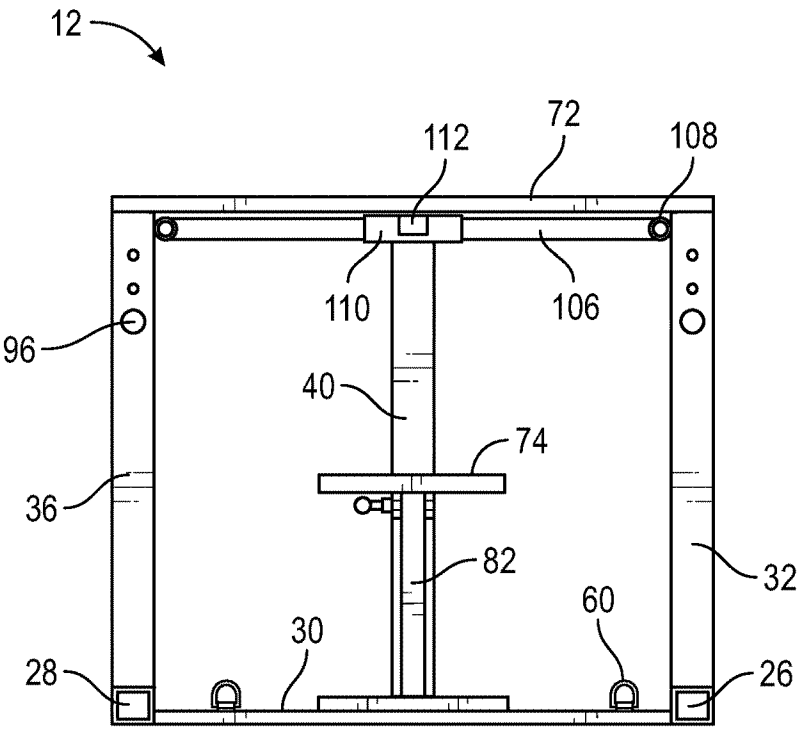

In one alternate embodiment, user 14 holds and pulls U-shaped bar 106 while ensuring that U-shaped bar 106 is stowed under first table top 72 and releases to strengthen his arms. Here, user 14 exercises by pulling and releasing U-shaped bar 106 along rails 104 to strengthen his arm muscles. When not in use, user 14 lifts U-shaped bar 106 and slides such that pins 108 reach closer to second end 20. Here, U-shaped bar 106 positions underneath first table top 72 as shown in FIG. 18. In other words, U-shaped bar 106 is stowed under first table top 72 when not in use.

The presently disclosed exercise apparatus can come with various additional options, such as a mobile application designed to build a community, as is known in the art, and assist users with achieving optimal results with the help of instructors. A monitor may be placed on the apparatus when used as a desk. The monitor may be connected a computer that can show video on demand and live streaming exercise routines, and provide personal instructions while using the exercise apparatus. The instructors can be configured the same as equipment to mirror the user. Optionally, the exercise apparatus can be configured to calculate calories burned by the user exercising and vibrate the table to alert the user about when it is time to eat or alert them as to whether they are doing something that hurts their health. In such situations, instructors will be able to tilt the camera and swivel it to allow the user to use the space while keeping a connection with the instructor. Additional features may include integration with services that provide a snapshot of users with health statistics and may also include smart enable features such as counting pull ups, reps of bench press, amount of weight lifted, and the like.

Alternatively, the exercise apparatus can come with an option for use as a coffee table. Here, the coffee table operates like any ordinary coffee table, and rectangular to compliment a couch.

REFERENCE NUMBERS

12 exercise apparatus
14 user
16 main frame
18 first end (of main frame)
20 second end (of main frame)
22 first side (of main frame)
24 second side (of main frame)
26 first base arm
28 second base arm
30 third base arm
32 first leg (on first end of main frame)

34 second leg (of second end of main frame)
36 third leg (on first end of main frame)
38 fourth leg (on second end of main frame)
40 fifth leg (on second end of main frame, the center rear leg)
42 first top arm
44 second top arm
46 cut out section
48 telescopic members
48*a* first telescopic member
48*b* second telescopic member
49 pin holes
50 pin
52 L-shaped arm
54 pulley
56 cable
58 hand grip
60 hooks
62 elongated arm
64 rod
66 loop
68 slidable sleeve
70 weight bearing projection
72 first table top
74 second table top
76 platform (can be hingedly connected)
78 top surface (of platform)
80 bottom surface (of platform)
82 support legs (of platform)
84 L-shaped base
86 levers
88 clips
90 receiving rods
92 electronic device
94 U-section member
96 barbell holding projection
98 barbell bar
100 weights (for barbell bar)
102 weights (for weight bearing projection)
104 rails
106 U-shaped bar
108 pins (along rails)
110 foot bar
112 weight (for leg press)

The embodiments provide for several advantages over the prior art. For example, One problem this invention solves is that it conserves space by combining a workout apparatus and a desk or table top, preventing a possible eyesore of exercise equipment in a bedroom or living room. As a desk, the furniture looks to the naked eye as an ordinary piece of furniture that keeps up with current design trends that appeal to the users' desire and presents a more professional appearance of an office space.

Another advantage is that the user can exercise in this area and avoid finding space for other products that must be stored in a closet or under a bed. The conversion from furniture to exercise equipment is quick and efficient.

Various kinds of gym quality exercises are integrated into the design of the furniture so that when the furniture is in its home state, it does not appear as exercise equipment, and/or the exercise parts will supplement the furniture.

The presently disclosed exercise apparatus allows for usage as furniture to place electronic device or use as a dining table, etc. Further, the exercise apparatus transforms into a gym equipment and configures into a different exercise apparatus allowing the user to perform different exercises with a single apparatus. The exercise apparatus is portable and allows for easy storage in a room. Depending on the need, the user may transform the exercise apparatus into a furniture or any other desired exercise apparatus to exercise or muscle building. The exercise apparatus stores all components within its own structure without occupying additional surface or ground area within a given room or office. This allows to efficiently utilize the space, more specifically the floor surface area, within a given environment, room or office while gaining the benefits of a furniture and/or gym equipment. The exercise apparatus provides a single apparatus that transforms into different exercise equipment and avoids use of expensive exercise apparatuses for performing different exercise as known in the art. The exercise apparatus is easy to assemble and disassemble by a single user. When not in use, the exercise apparatus allows for usage as a table for simply placing items such as desktop, clothes, accessories, etc. The presently disclosed exercise apparatus transforms and provides multi-purpose utility that combines exercise equipment with furniture to give an unprecedented home exercise experience to a user.

The exercise apparatus is relatively small when compared to expensive gym equipment. As such, the user can easily place the exercise apparatus at one place and use it as furniture and also as a workout apparatus for performing various exercises. A person skilled in the art understands that the exercise apparatus utilizes space efficiency, requires less resources and materials to manufacture, making less of an ecological or environmental impact on the earth's resources. The exercise apparatus can be manufactured more inexpensively than most exercise apparatuses and, therefore, be sold to users at a lower price point than many exercise apparatuses that are currently on the market. The presently disclosed exercise apparatus allows user to perform various exercises and build muscles at home itself without having to go to a gym. Further, when needed, he can simply transform the exercise apparatus into a furniture for use as a dining table, work station, etc. all the while utilizing the same space.

A person skilled in the art appreciates that the exercise apparatus may come in a variety of shapes and sizes depending on the need and comfort of the diner. Further, different materials in addition to or instead of materials described herein may also be used and such implementations may be construed to be within the scope of the present invention. Further, many changes in the design and placement of components may take place without deviating from the scope of the presently disclosed exercise apparatus.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

While the invention has been described in terms of exemplary embodiments, it is to be understood that the words that have been used are words of description and not of limitation. As is understood by persons of ordinary skill in the art, a variety of modifications can be made without departing from the scope of the invention defined by the following claims, which should be given their fullest, fair scope.

What is claimed is:

1. A transformable exercise apparatus, comprising:

a) a main frame having i) a pair of base arms arranged substantially parallel to each other;

ii) a pair of front legs extending substantially perpendicular from the pair of base arms;

iii) a pair of rear legs extending substantially perpendicular from the pair of base arms;

iv) a pair of top arms, each of the pair of top arms connecting a respective front leg with a respective rear leg;

b) a plurality of telescopic members stored in the pair of front legs; and c) a first table top and a second table top, wherein the second table top comprises collapsible legs;

wherein the collapsible legs fold and allow for placing the second table top and the first table top over the pair of top arms, thereby transforming the exercise apparatus into furniture.

2. The transformable exercise apparatus of claim 1, wherein the second table top is capable of demounting from the pair of top arms, wherein the collapsible legs extend from a collapsed configuration for placement on the pair of top arms to an expanded configuration for placement on the ground, thereby transforming the second table top into a workbench.

3. The transformable exercise apparatus of claim 1, wherein the plurality of telescopic members comprise pins for retaining the plurality of telescopic members for positioning the pull-up bar at a height from the ground.

4. The transformable exercise apparatus of claim 1, wherein the plurality of telescopic members can collapse, thereby adjusting the height of the pull-up bar from the ground for transforming the exercise apparatus into a straight bar dips exercise apparatus.

5. The transformable exercise apparatus of claim 1, wherein the pair of front legs comprises a barbell holding projection for holding a barbell having weights.

6. The transformable exercise apparatus of claim 1, wherein the second table top comprises clips for storing a barbell bar, thereby saving space.

7. The transformable exercise apparatus of claim 1, wherein the pair of base arms comprise hooks, and wherein the hooks receive elastic bands for allowing a user to perform stretch cord exercises.

8. The transformable exercise apparatus of claim 1, wherein the pair of base arms comprise an additional base arm that mounts perpendicularly to the pair of base arms, wherein the additional base arm comprises a center rear leg, wherein the center rear leg comprises a slidable sleeve with a weight bearing projection, whereby the weight bearing projection is capable of receiving weights.

9. The transformable exercise apparatus of claim 8, wherein one of the pair of rear legs stores a L-shaped arm and the other rear leg stores an elongated arm, wherein the L-shaped arm comprises a pulley having a cable, and wherein one end of the cable comprises a hand grip and the other end mounts to the slidable sleeve.

10. The transformable exercise apparatus of claim 9, wherein the elongated arm mounts over the center rear leg, and the L-shaped arm mounts over the elongated arm, thereby transforming the center rear leg, the elongated arm, and the L-shaped arm into a lat pull-down exercise apparatus with the additional base arm.

11. The transformable exercise apparatus of claim 1, wherein the pair of top arms each comprises rails, wherein the rails are adapted to receive a U-shaped bar, and wherein the U-shaped bar slides along the rails for transforming the exercise apparatus into a row exercise apparatus or leg press apparatus.

12. The transformable exercise apparatus of claim 1, wherein the pair of top arms comprises rails, wherein the rails receive a U-shaped bar, wherein the U-shaped bar comprises a foot bar configured to slide along the U-shaped bar, and wherein the U-shaped bar slides along the rails for transforming the exercise apparatus into a leg press exercise apparatus.

13. The transformable exercise apparatus of claim 1, wherein the pair of top arms each comprises rails, wherein the rails receive a U-shaped bar, wherein the U-shaped bar slides along the rails transforming the exercise apparatus into a row exercise apparatus, and wherein the U-shaped bar rests underneath the first table top when not in use.

14. The transformable exercise apparatus of claim 1, wherein the pull-up bar is arranged substantially co-planar with the pair of top arms when not in use for pull-ups, thereby saving space.

* * * * *